US009127609B2

(12) United States Patent
Yu

(10) Patent No.: US 9,127,609 B2
(45) Date of Patent: Sep. 8, 2015

(54) EXHAUST GAS RECIRCULATION SYSTEM AND CONTROL STRATEGY

(75) Inventor: Songping Yu, Troy, MI (US)

(73) Assignee: FCA US LLC, Auburn Hills, MI (US)

( * ) Notice: Subject to any disclaimer, the term of this patent is extended or adjusted under 35 U.S.C. 154(b) by 457 days.

(21) Appl. No.: 13/476,106

(22) Filed: May 21, 2012

(65) Prior Publication Data

US 2013/0306042 A1 Nov. 21, 2013

(51) Int. Cl.

| | |
|---|---|
| ***F02M 25/07*** | (2006.01) |
| ***F02D 41/14*** | (2006.01) |
| ***F02D 37/02*** | (2006.01) |

(52) U.S. Cl.

CPC ..... *F02D 41/1497* (2013.01); *F02D 37/02* (2013.01)

(58) Field of Classification Search

CPC ..... Y02T 10/47; Y02T 10/42; Y02T 10/44; F02M 25/0707; F02M 25/0727; F02D 41/0065; F02D 41/0072; F02D 41/10

USPC ..... 123/339.14, 339.16, 339.18, 568.11, 123/568.18–568.21, 568.24, 568.26; 701/101–104, 108, 110, 54, 84, 93

See application file for complete search history.

(56) References Cited

U.S. PATENT DOCUMENTS

| | | | | |
|---|---|---|---|---|
| 4,719,893 | A * | 1/1988 | Buslepp et al. | 123/568.21 |
| 4,721,089 | A * | 1/1988 | Currie et al. | 123/406.42 |
| 5,775,099 | A * | 7/1998 | Ito et al. | 60/274 |
| 6,367,462 | B1 | 4/2002 | McKay et al. | |
| 6,976,481 | B2 * | 12/2005 | Kobayashi et al. | 123/568.12 |
| 2006/0086080 | A1 * | 4/2006 | Katogi et al. | 60/278 |
| 2008/0167790 | A1 * | 7/2008 | Kotooka et al. | 701/108 |
| 2008/0243355 | A1 | 10/2008 | Whitney et al. | |
| 2009/0037073 | A1 * | 2/2009 | Jung et al. | 701/101 |
| 2010/0057325 | A1 * | 3/2010 | Livshiz et al. | 701/102 |
| 2010/0057330 | A1 * | 3/2010 | Whitney et al. | 701/103 |
| 2010/0116250 | A1 | 5/2010 | Simon, Jr. et al. | |
| 2010/0235070 | A1 * | 9/2010 | Amano | 701/103 |
| 2010/0262356 | A1 * | 10/2010 | Maruyama | 701/103 |
| 2010/0263627 | A1 * | 10/2010 | Whitney et al. | 123/399 |
| 2011/0118959 | A1 * | 5/2011 | Porten et al. | 701/108 |
| 2011/0180045 | A1 * | 7/2011 | Hosokawa et al. | 123/48 R |

OTHER PUBLICATIONS

International Search Report and Written Opinion dated Aug. 21, 2013 for International Application No. PCT/US2013/036585, International Filing Date Apr. 15, 2013.

* cited by examiner

*Primary Examiner* — Stephen K Cronin
*Assistant Examiner* — Joseph Dallo
(74) *Attorney, Agent, or Firm* — Ralph E. Smith

(57) ABSTRACT

A method for controlling a vehicle's exhaust gas recirculation system. The method controls the exhaust gas recirculation system in a manner that is suitable for a pedal tip-out transition while also being optimized for normal operating situations.

6 Claims, 3 Drawing Sheets

EXHAUST GAS RECIRCULATION SYSTEM AND CONTROL STRATEGY

FIELD

The present disclosure relates generally to internal combustion gas engines and more particularly to a method of controlling an exhaust gas recirculation system for such engines.

BACKGROUND

Exhaust gas recirculation (EGR) is used in many internal combustion (IC) engines, and particularly gasoline and diesel engines. In an EGR system, a portion of an engine's exhaust gas is recirculated back to the engine cylinders. Therefore, at a time when a cylinder allows fuel, oxygen and other combustion products into the combustion chamber for ignition, vehicle exhaust is also allowed to enter the chamber.

The introduction of vehicle exhaust into the combustion chamber has a number of consequences. One consequence is that the introduced exhaust displaces the amount of combustible matter in the chamber. Because the exhaust gases have already combusted, the recirculated gases do not burn again when introduced to the chamber. This results in a chemical slowing and cooling of the combustion process by several hundred degrees Fahrenheit. Thus, combustion of material in the cylinder results in a same pressure being exerted against the cylinder piston as results from combustion without the recycled exhaust, but at a lower temperature. The lower temperature leads to a reduced formation rate for nitrous oxide emissions. Thus, the EGR technique results in less pollutants being emitted in an engine's exhaust.

Additionally, the introduction of recirculated exhaust gas into an engine cylinder allows for an increase in engine performance and fuel economy. As the combustion chamber temperature is reduced, the potential for harmful "engine knock" or engine detonation is also reduced. Engine detonation occurs when the fuel and air mixture in a cylinder ignite prematurely due to high pressure and heat. In engine detonation, instead of an associated spark plug controlling when a cylinder's fuel is ignited, the ignition occurs spontaneously, often causing damage to the cylinder. However, when the combustion chamber temperature is reduced due to EGR, the potential for engine detonation is also reduced. This allows vehicle manufacturers to program more aggressive (and hence, more efficient) timing routines into an associated spark timing program. Because of the aggressive timing routines, the vehicle's power control module (PCM) has a greater advance notice and thus more time to take measures to prevent engine detonation. The aggressive timing routines can also result in higher cylinder pressures leading to increased torque and power output for the vehicle. For these and additional reasons, high levels of EGR are especially useful when applied to turbocharged or supercharged engines.

Accelerator pedal "tip-out" is the well known phrase referring to the action of a driver releasing the pedal from a depressed position to a zero (i.e., completely released) or near zero (i.e., mostly released) position. Upon a pedal tip-out, the driver expects the engine's output power to be abruptly reduced. It is a well-known technical challenge to manage EGR flow for the pedal tip-out situation.

When the engine operates at a partial load, it is desirable to have a high EGR rate for better fuel economy and lower emissions. While at idle, however, the engine has little tolerance for EGR flow. When a pedal tip-out occurs, air already mixed with a high portion of recirculated exhaust gas in the intake manifold has to go through engine combustion to exit the vehicle. As such, there may be a delay before the throttle is completely closed to ensure that the recirculated exhaust gas exits the vehicle. Delaying throttle closing to keep the engine running at the partial load, however, may result in safety concerns. On the other hand, an immediate throttle closing will cause engine combustion instability.

Due to this dilemma, a common approach in today's vehicles is to limit the EGR rate to a containable level even though a higher EGR rate will be more beneficial under most driving circumstance. Accordingly, there is a need and desire for an improved EGR scheme that is suitable for the pedal tip-out transition while also being optimized for normal situations (i.e., non-pedal tip-out situations).

SUMMARY

In one form, the present disclosure provides a method of controlling an exhaust gas recirculation system of a vehicle. The method comprises controlling an exhaust gas recirculation valve based on a current position of a vehicle accelerator pedal and predetermined exhaust gas recirculation valve closing limits; and performing active torque management based on driver requested torque in a slow path and driver requested torque in a fast path.

The present disclosure also provides an exhaust gas recirculation system of a vehicle. The disclosed system comprises an exhaust gas recirculation valve connected between a supply of exhaust gas and an intake manifold of an engine; and a controller connected to the exhaust gas recirculation valve. The controller is adapted to control the exhaust gas recirculation valve based on a current position of a vehicle accelerator pedal and predetermined exhaust gas recirculation valve closing limits; and perform active torque management based on driver requested torque in a slow path and driver requested torque in a fast path.

In one embodiment, controlling the exhaust gas recirculation valve comprises indexing a table comprising exhaust gas recirculation valve closing limits based on the current position of the accelerator pedal. In one embodiment, the current pedal position is a pedal tip-out position.

In another embodiment, the act of performing active torque management based on driver requested torque in the slow path comprises adjusting a throttle position. In yet another embodiment, the act of performing active torque management based on driver requested torque in the fast path comprises reducing fuel consumption of the vehicle.

Further areas of applicability of the present disclosure will become apparent from the detailed description, claims and drawings provided hereinafter. It should be understood that the detailed description, including disclosed embodiments and drawings, are merely exemplary in nature intended for purposes of illustration only and are not intended to limit the scope of the invention, its application or use. Thus, variations that do not depart from the gist of the invention are intended to be within the scope of the invention.

DETAILED DESCRIPTION

According to the principles disclosed herein, and as discussed below, an improved EGR scheme that is suitable for the pedal tip-out transition while also being optimized for normal situations (i.e., non-pedal tip-out situations) is provided. The method disclosed herein addresses the challenges associated with pedal tip-out and the flow of recirculated exhaust gas from two perspectives: 1) improving the EGR actuator response to the driver's maneuver to cut-off the EGR flow sooner and 2) actively managing engine torque to meet the driver's request while delaying throttle closing to stabilize engine combustion.

Figure 1:
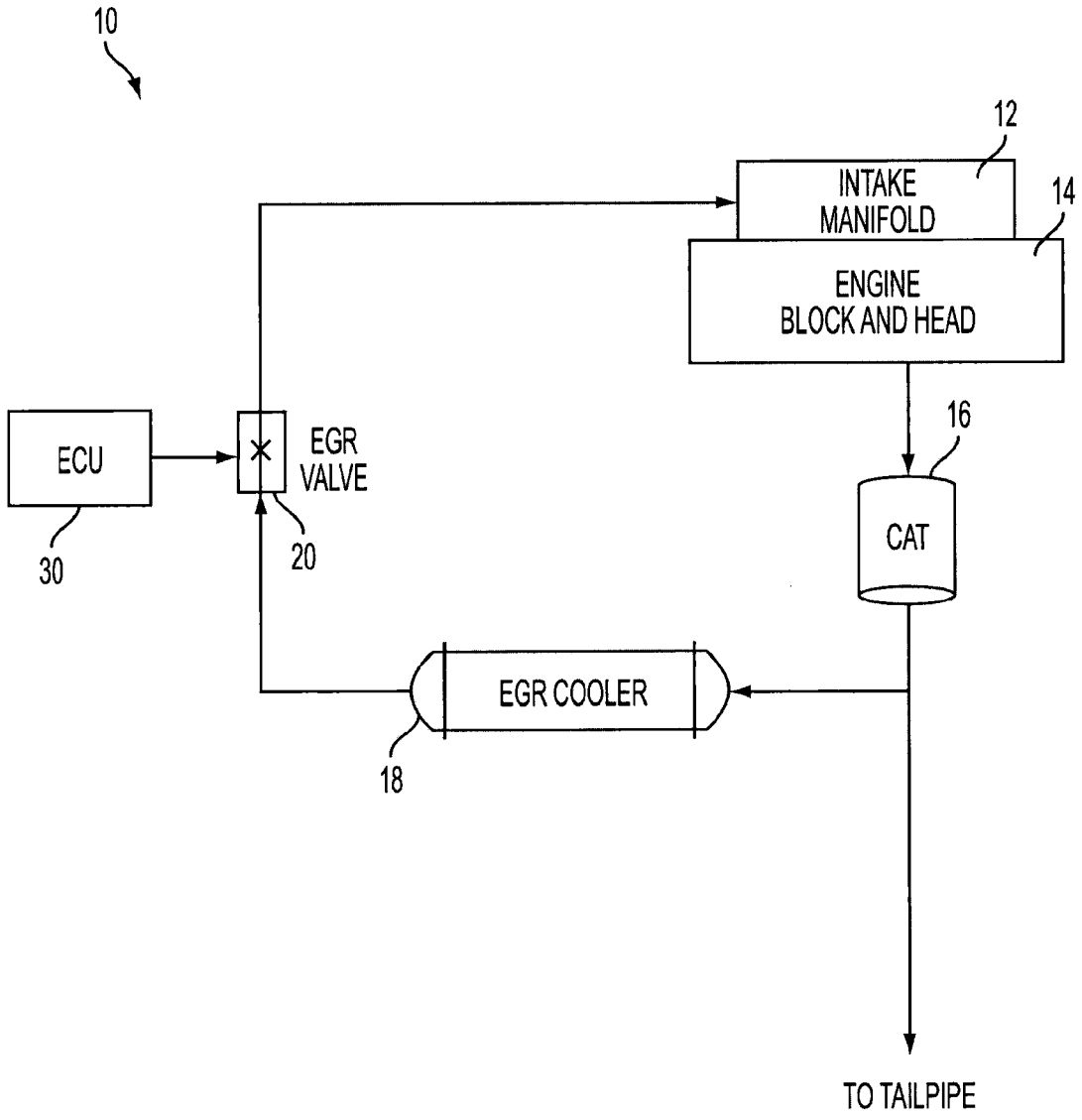
FIG. 1 illustrates an exhaust gas recirculation system for a vehicle.

FIG. 1 illustrates an example EGR system 10 for a vehicle that may be programmed to perform the novel control method 100 (FIG. 2) disclosed herein. The system 10 comprises an intake manifold 12 connected to an engine block 14. Exhaust from the engine block 14 is passed through a catalytic converter 16, an EGR cooler 18 and an EGR valve 20. The valve 20 is controlled by an engine control unit (ECU) 30 or other suitable controller. It should be appreciated that necessary piping/tubing and connections to components within the system 10 are illustrated as connection arrows for convenience purposes and are not numerically labeled in FIG. 1. In the illustrated EGR system 10, a portion of the exhaust gas (approximately 35%-40%) from the engine block 14 is split off from the main exhaust piping and routed through the EGR cooler 18. The entire portion of the cooled exhaust gas that went through the cooler 18 is then routed back to the engine intake manifold 12 where it is mixed with fresh air and re-introduced into the combustion chamber of the engine block 14. It should be appreciated that FIG. 1 illustrates one example system 10 and the principles disclosed herein are not limited solely to the FIG. 1 illustrated configuration.

Figure 2:
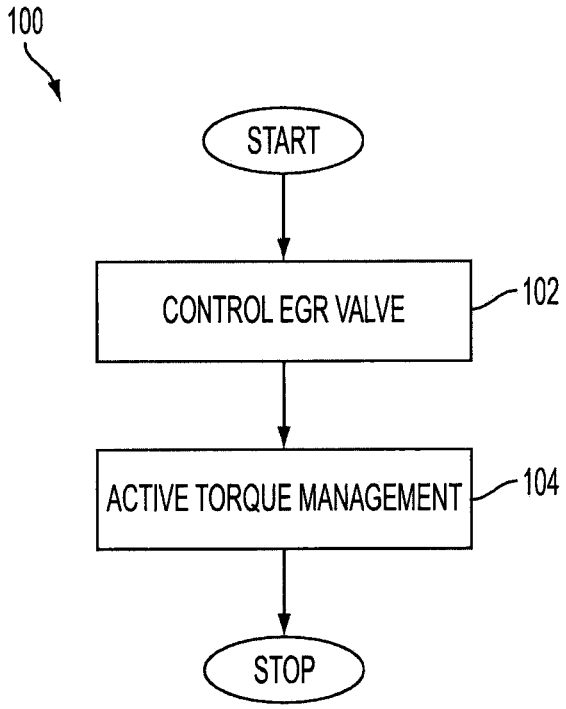
FIG. 2 illustrates a flowchart of a method of controlling a vehicle's exhaust gas recirculation system in accordance with an embodiment disclosed herein.

FIG. 2 illustrates a method 100 of controlling a vehicle's exhaust gas recirculation system in accordance with an embodiment disclosed herein. In a desired embodiment, the method 100 is implemented in software, stored in a computer readable medium, which could be a random access memory (RAM) device, non-volatile random access memory (NVRAM) device, or a read-only memory (ROM) device) and executed by the engine control unit 30 or other suitable controller within the system 10 of FIG. 1. The computer readable medium can be part of the ECU 30. As can be seen, the method 100 comprises a first step of controlling the EGR valve (step 102) and a second step of actively managing the engine's torque (step 104). Details of the EGR valve controlling step 102 and the active torque management step 104 are described below. The combination of these steps overcomes the deficiencies of today's EGR/tip-out techniques. Although shown sequentially, it should be appreciated that steps 102 and 104 can be performed concurrently.

Regarding the EGR valve controlling step 102, it is noted that standard EGR control is typically based on the amount or percentage of fresh air in the engine's cylinders. The determination of how much fresh air is in the cylinders is based in part on the accelerator pedal's position. A calculation is made and an appropriate EGR schedule is created from state variables, such as air charge, manifold air pressure (MAP), and others. As noted above, this type of control and scheduling may cause a delayed response during a pedal tip-out transition. As such, the disclosed EGR valve controlling step 102 is designed to adjust the EGR valve (and thus, the scheduled EGR) immediately and without the conventional calculations.

To that end, during calibration, a two-dimensional calibration table is created and defines an upper limit (also referred to as a clip) for EGR valve opening as a function of pedal sensor readings as shown in the following equation:

$$\text{EGR Valve Upper Limit}=\text{FUNC}(\text{pedal position}) \quad (1)$$

The table contains a list of EGR valve upper limits and is indexed by pedal position. The table can have as many entries deemed suitable for proper EGR valve control. The table can be filled initially with default values prior to calibration and then populated with values based on the calibration. At step 102, during a tip-out situation, the clip will force EGR valve closing right away based on the pedal position, rather than the normal EGR schedule, to reflect the driver's intent. This action will speed up EGR valve response significantly.

Figure 3:
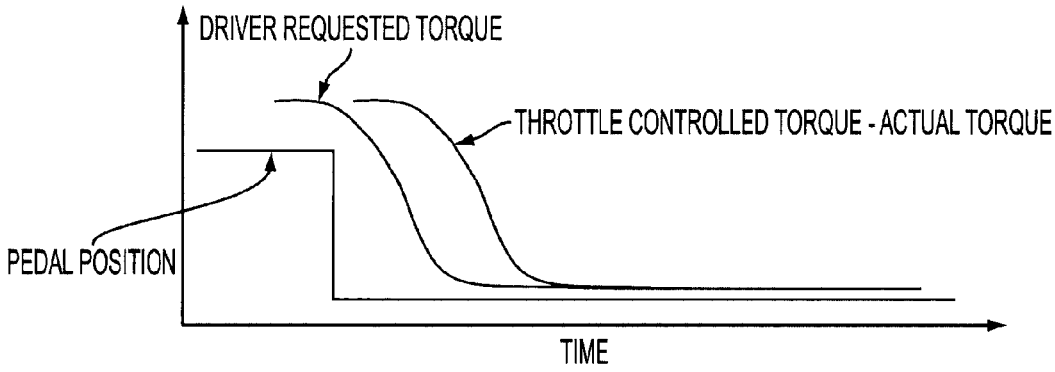
FIG. 3 PRIOR ART
FIG. 3 illustrates a conventional torque management strategy for a tip-out transition.

Prior to discussing the details of the active torque management step 104, a typical engine torque strategy for a tip-out transition is now discussed with reference to FIG. 3. As shown in FIG. 3, there is a pedal position curve, a driver requested torque curve and a throttle controlled torque curve (illustrating the actual torque). Throttle controlled torque is a mechanism for controlling torque via the air flow into the engine. This type of control is referred to herein as the "slow path." Another type of torque control uses fuel adjustment and is referred to herein as the "fast path" (discussed below in more detail). In the FIG. 3 technique, since there is no driver demanded torque in the fast path, the driver demanded torque is delivered through throttle action (i.e., the slow path). The time difference between the actual torque and the driver requested torque is due to intake manifold volume.

Figure 4:
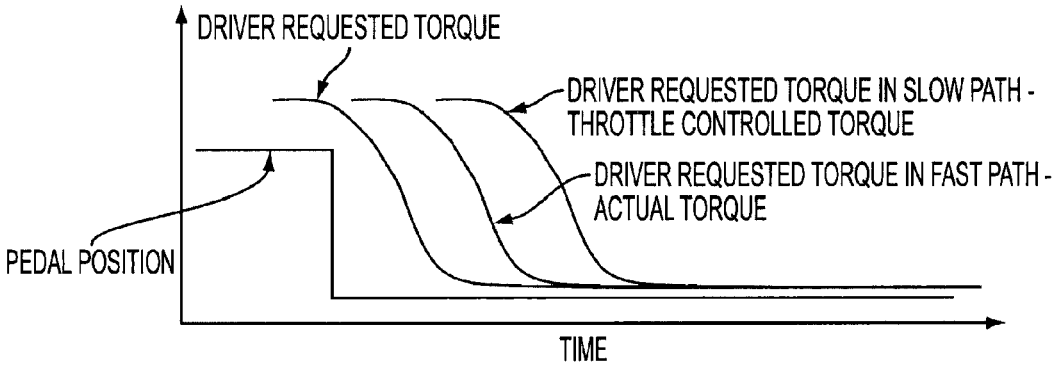
FIG. 4 illustrates an active torque management strategy for a tip-out transition in accordance with an embodiment disclosed herein.

Referring now to FIG. 4, the details of the active torque management step 104 are now described. FIG. 4 shows a pedal position curve, a driver requested torque curve, a driver requested torque in the slow path curve (illustrating throttle controlled torque) and a driver requested torque in the fast path curve (illustrating the actual torque). As can be seen, step 104 uses an additional torque parameter—driver requested torque in the fast path—that is created and used to match the current torque response.

The delayed throttle response (i.e., driver requested torque in the slow path) to the driver request will allow any pre-existing air-EGR mixture in the intake manifold to exit without combustion instability. The driver requested torque in the fast path, on the other hand, will ensure that the actual engine torque meets the driver's demanded torque. As noted above, the torque reduction due to the driver requested torque in the fast path will be achieved with fuel adjustment, which in this case is fuel reduction (i.e., a lean burn). Although not shown in the Figures, the ECU 30 can control the throttle positioning and the fuel reduction required to perform the active torque management step 104 disclosed herein.

It should be appreciated that combining the control method 100 discussed herein with some potential hardware optimizations, such as e.g., EGR inlet relocation, intake manifold sizing, etc., can provide a viable option for the management of EGR flow during a tip-out transition, without compromising the desired level of EGR scheduling and vehicle drivability. As such, the embodiments disclosed herein should not be limited solely with use in the system 10 illustrated in FIG. 1.

What is claimed is:

1. A method of controlling an exhaust gas recirculation system of a vehicle, said method comprising:

controlling an exhaust gas recirculation valve based on a current position of a vehicle accelerator pedal and predetermined exhaust gas recirculation valve closing limits;

when the current position of the vehicle accelerator pedal is a pedal tip-out position, immediately closing the exhaust gas recirculation valve without reference to the predetermined exhaust gas recirculation valve closing limits; and performing active torque management based on driver requested torque in a slow path and driver requested torque in a fast path to meet driver torque demand based on accelerator pedal position, including:

in the fast path, reducing fuel consumption so as to meet the driver torque demand using fuel control while, in the slow path, delaying closing a throttle of the engine relative to the driver torque demand to provide for residual EGR in an intake manifold of the engine to exit the intake manifold.

2. The method of claim 1, further comprising:

calibrating the system using a predetermined number of accelerator pedal positions; and creating a table of exhaust gas recirculation valve closing limits for each pedal position.

3. The method of claim 2, wherein the step of controlling the exhaust gas recirculation valve comprises indexing the table based on the current position of the accelerator pedal.

4. An exhaust gas recirculation system of a vehicle, said system comprising:

an exhaust gas recirculation valve connected between a supply of exhaust gas and an intake manifold of an engine; and a controller connected to the exhaust gas recirculation valve, said controller configured to:

control the exhaust gas recirculation valve based on a current position of a vehicle accelerator pedal and predetermined exhaust gas recirculation valve closing limits;

when the current position of the vehicle accelerator pedal is a pedal tip-out position, immediately closing the exhaust gas recirculation valve without reference to the predetermined exhaust gas recirculation valve closing limits; and performing active torque management based on driver requested torque in a slow path and driver requested torque in a fast path to meet driver torque demand based on accelerator pedal position, including:

in the fast path, reducing fuel consumption so as to meet the driver demanded torque based on fuel control while, in the slow path, delaying closing a throttle of the engine relative to the driver torque demand to provide for residual EGR in an intake manifold of the engine to exit the intake manifold.

5. The system of claim 4, further comprising a memory device for storing a table of exhaust gas recirculation valve closing limits for a predetermined number of accelerator pedal positions, wherein the system is calibrated to determine the exhaust gas recirculation valve upper limits for the predetermined number of accelerator pedal positions.

6. The system of claim 5, wherein the controller controls the exhaust gas recirculation valve by indexing the table based on the current position of the accelerator pedal.

* * * * *